United States Patent [19]

Wallschlaeger, Sr.

[11] Patent Number: 5,010,818

[45] Date of Patent: Apr. 30, 1991

[54] TENSIONLESS PLATE LOCK-UP

[75] Inventor: Alan R. Wallschlaeger, Sr., Elmhurst, Ill.

[73] Assignee: Rockwell International Corporation, Pittsburgh, Pa.

[21] Appl. No.: 437,877

[22] Filed: Nov. 17, 1989

Related U.S. Application Data

[63] Continuation of Ser. No. 161,640, Feb. 29, 1988, abandoned.

[51] Int. Cl.[5] ..... B41F 27/12

[52] U.S. Cl. ..... 101/415.1; 101/378

[58] Field of Search ..... 101/415.1, 378, 382

[56] References Cited

U.S. PATENT DOCUMENTS

| | | | |
|---|---|---|---|
| 3,896,727 | 7/1975 | Ruckdeschel, Jr. | 101/415.1 |
| 4,421,024 | 12/1983 | Burger et al. | 101/415.1 |
| 4,495,865 | 1/1985 | Kamada | 101/415.1 |

*Primary Examiner*—Edgar S. Burr
*Assistant Examiner*—Moshe I. Cohen

[57] ABSTRACT

A printing cylinder having a longitudinal slot formed in the surface thereof to define at least one undercut surface against which both ends of a flexible printing plate are clamped to hold the plate securely against the surface of the cylinder. A plurality of individual cylinders is substantially evenly spaced along the length of said longitudinal slot. An individual biasing spring is disposed in operative compression between the bottom of the longitudinal slot, and a spring receiving opening in each of the cylinders urges individually each cylinder outwardly against the overlapping ends of the plate to hold them against the undercut surface. A spacer is secured to the bottom of the longitudinal slot, said spacer includes a plurality of evenly spaced protruding studs which receive the individual biasing spring to hold the spring at fixed locations.

2 Claims, 2 Drawing Sheets

TENSIONLESS PLATE LOCK-UP

This application is a continuation of application Ser. No. 161,640, filed 2/2/88 now abandoned.

The present invention relates to offset lithographic presses and more particularly to lock-up mechanisms for holding the thin, flexible litho plates to the surface of the plate roll.

BACKGROUND OF THE INVENTION

The art of printing by offset lithography involves the use of thin, flexible plates which are basically planographic, that is without relief, and which are treated so that the surfaces have areas which attract or repel oil and water to create areas of image differentiation. To mount the litho plates on the surface of the press plate rolls, it is essential to insure that the plate conforms closely to the outer surface of the plate roll. Mounting is usually effected by forming a longitudinal slot in the plate roll and inserting thereinto one of a variety of biasing or clamping devices called lockups. Often the leading edge of the plate is bent back on itself so that the bent portion can fit over the edge formed in the roll by the longitudinal slot and then be held in position by some form of spring or clamp. Alternatively, mechanisms have been provided in which the plate leading edge has been rigidly clamped.

An example of the type of plate lock-up mechanism in which the leading edge of the plate is clamped can be seen by referring to U.S. Pat. No. 4,421.024. In this arrangement, the plate leading end portion E is held between two parts 5 and 6 which are of an approximate trapezoidal shape. The two parts 5 and 6 are urged inwardly to clamp the end of the plate within slot 3 by means of the spring 8. The trailing end of the plate, which is identified by the letter A, is held between the sloped surface of part 6 and the similarly sloped wall 10 of slot 3.

Another example of a plate lock-up is seen in U.S. Pat. No. 3,757,691 where the leading edge of plate 11 is held by one leaf of a spring member 16 while the trailing edge of plate 11 is held by another finger of the spring member 16. An elongated cam 18 is used to change the spring pressure exerted against the plate for purposes of unlocking and locking the plate in and from operating position, respectively.

A plate lock-up mechanism which is somewhat related to that of U.S. Pat. No. 3,757,691 is U.S. Pat. No. 3,626,848 where a spring member is used to hold down the leading edge of plate 11 around the undercut side of the slot and cam 40 is used to urge the hook 35 against the trailing end 13. Examples of other plate lock up mechanisms may be found in U.S. Pat. Nos. 3,608,847 and 3,095,811.

SUMMARY OF THE INVENTION

It is a principal object of this invention to provide an improved plate lock-up mechanism in which both the leading and trailing edges of the plate are held securely in position during operation.

An additional object of this invention is to provide a printing plate lock-up mechanism which the plate can be installed on the plate roll and removed therefrom without the necessity of having installation or removal equipment.

An additional object of this invention is to provide a plate lock-up mechanism in which the width of the plate gap is held to a minimum.

A further object of this invention is to provide an improved plate lock-up mechanism which can be adapted for use with plate rolls having longitudinal slots that were structured for use with previously existing plate lock-up mechanisms.

These and additional objects and advantages of this invention will be in part obvious and in part explained by reference to the accompanying specification and drawings, in which.

DESCRIPTION OF THE PREFERRED EMBODIMENT

Figure 1:
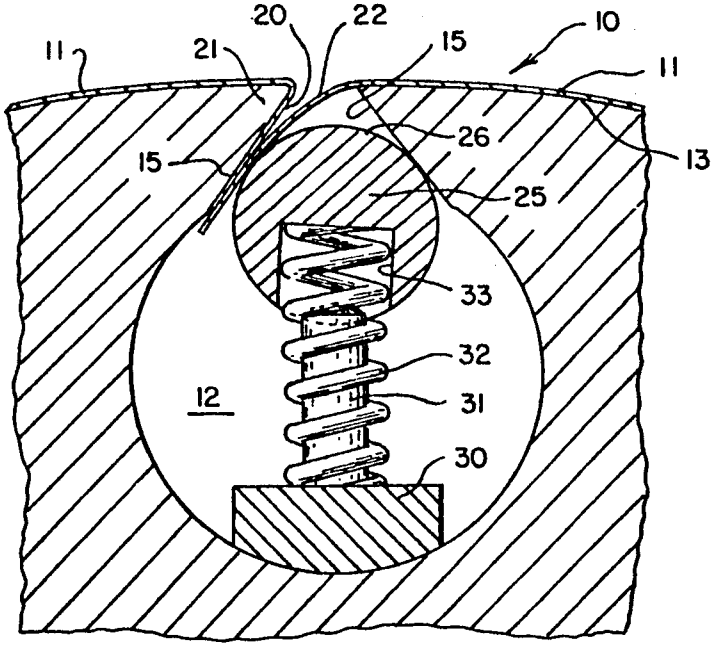
FIG. 1 is a partial cross-sectional view through an improved plate lock-up mechanism in which the plate lock-up gap is held to a minimum.

In order to more clearly understand the present invention, reference is made to the drawings and more particularly to FIG. 1. In this figure, numeral 10 indicates a section through a portion of a plate roll upon which a plate 11 disposed. The plate roll 10 is formed with longitudinal groove 12 in its outer surface 13, the longitudinal slot extending all the way across the width of the plate roll.

Longitudinal slot 12 is shown as being undercut to define a pair of opposed surfaces 15 which provide locking surfaces against which both the leading and the trailing ends of plate 11 can be abutted. From the slot inwardly, the substantially flat or planar clamping surfaces 15 terminate in a curved wall, the shape being of no particular significance, since the shape is largely dictated by the machining operation selected for forming the slot.

In FIG. 1 it can be seen that the leading edge 20 of plate 11 has been folded back at an acute angle to the plate (and to the surface of the roll) so that it fits over the nose portion 21 of the roll 10. The trailing edge 22 is not, unlike the leading edge, bent back on itself but rather extends over the opening of longitudinal slot 12 so that it is in abutment with the innermost surface of leading edge 20.

The leading and trailing edges 20 and 22 are held against each other and against one of the clamping surfaces 15, by the locking means 25. Each locking means has a curved outer surface 26 for contacting the ends of the flexible plate and clamping them against the locking surface 15. It will be noted that the radius of curvature of each of the locking elements 25 is such that the contact between the curved outer surface with the substantially planar surface 15 is one of basically line contact, so that firm contact is made with the surface of the printing plate. By having line as opposed to areal contact with the plate, insertion and removal of the plate ends from locking engagement are made easier than would otherwise be the case.

Figure 2:
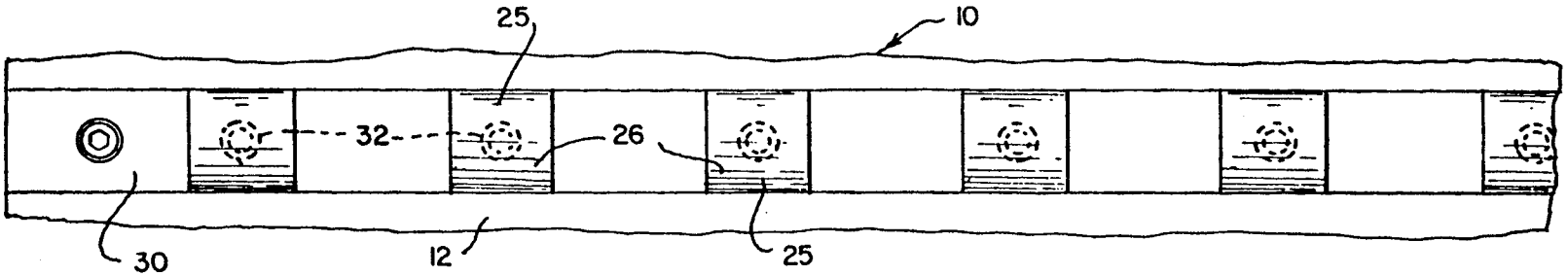
FIG. 2 is a partial plan elevation of the lock-up of FIG. 1.

As can be seen by referring to FIG. 2 of the drawings, the locking means 25 are spaced at substantially equal intervals along the length of the longitudinal slot 12 across the width of plate roll 10. It will be appreciated by consideration of FIGS. 1 and 2 together that, in the structure shown, each of the locking elements 25 is substantially cylindrical in shape.

In order to dispose the elements 25 at proper intervals along the length of slot 12 and to urge them outwardly against the clamping surfaces 15, a spacer bar 30 is disposed within the slot. This bar has a plurality of upwardly and outwardly extending mounting posts or spacing studs 31 each of which is surrounded by a compression spring 32. In order that the locking elements 25 be urged outwardly and retained in position, the bottom part of each of the elements 25 contains a cylindrical bore 33 for reception of the upper end of a spring 32. By this combination of stud 31 and opening 33, it is possible for the springs 32 to retain each element 25 in a predetermined or preselected location while urging the locking element 25 curved outer surface toward engagement with a planar surface 15.

Utilizing the configuration shown in FIG. 1, where longitudinal slot 12 is formed with two undercut interlocking surfaces 15, it is possible for the plate roll to be utilized for rotation in either a clockwise or a counterclockwise direction. In either case, the lock-up is performed in the manner shown in FIG. 1, although two ends would be located on the right hand side of locking element 25 in case rotation in the opposite direction were desired. In order to lock up a plate, it is necessary only to depress the locking elements 25 slightly by inserting the leading end 20 into the longitudinal slot. The plate is then wrapped all the way around the roll and the trailing edge inserted into the slot so that it rides down against the inner surface of leading edge 20 to arrive at the assembled and locked position illustrated in the drawings. With this particular configuration, it will be appreciated that upon rotation of the plate roll against the blanket cylinder, there tends to be a flattening and ironing out of the plate so that it is urged tightly against the outer surface 13 of the plate roll. The slight elongation that often occurs in the plate then pushes the end further into the region between locking element 25 and locking surface 15 to hold the plate in tight operating relationship.

Figure 3:
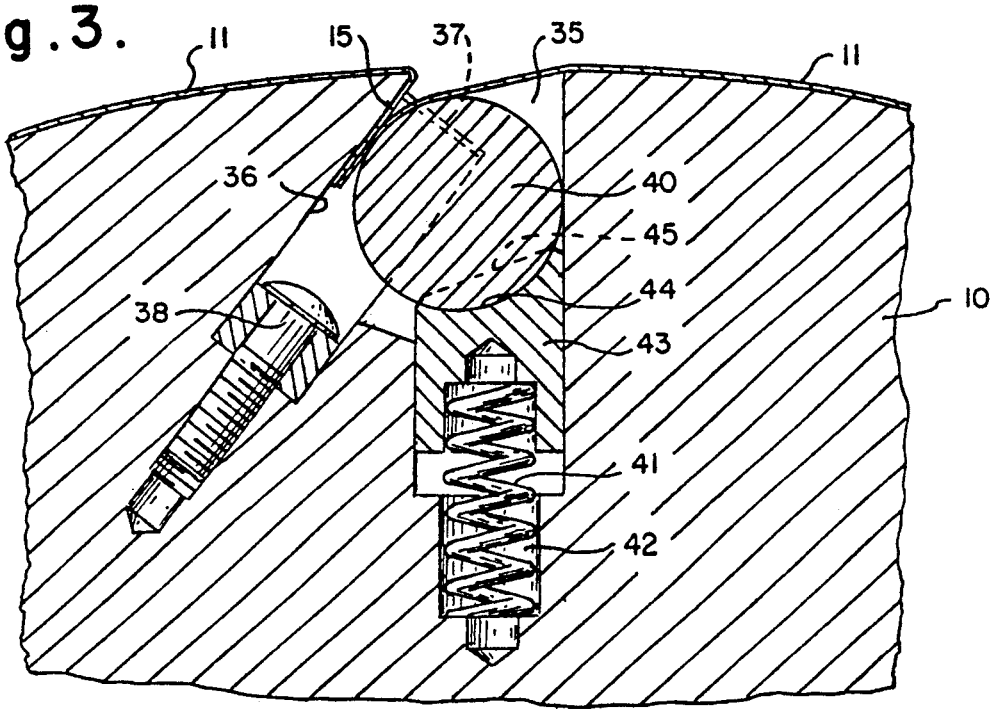
FIG. 3 is a cross-sectional view similar to FIG. 1 showing a modified form of plate lock-up.
Figure 4:
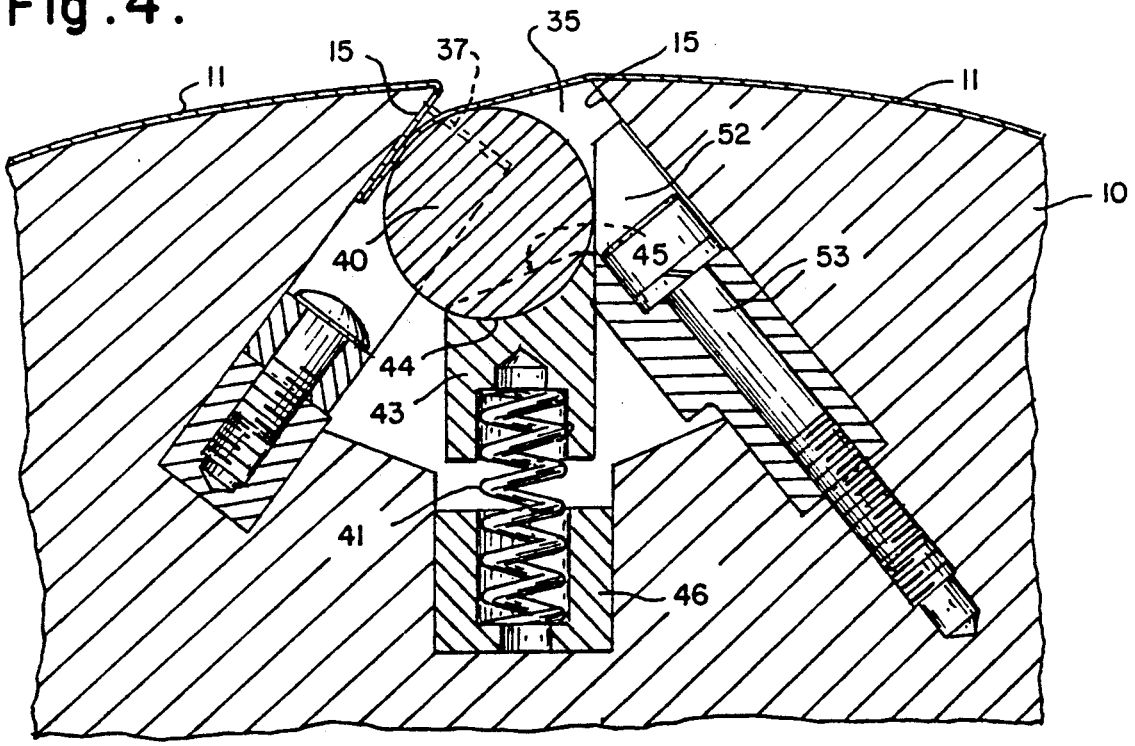
FIG. 4 is a cross-sectional view similar to those of FIGS. 1 and 3 showing yet another modified plate lock-up.

An important feature of the present lock-up is its ability for use in longitudinal slots that have been used in existing plate rolls in the field. FIGS. 3 and 4 illustrate the manner in which this can be effected. Referring first to FIG. 3, it will be seen that the slot 35 has been formed with only one undercut surface 36 while the other side wall of the slot is essentially vertical. In this case, there is shown a spacer bar mechanism 38 that is secured into a small secondary recess by means of a bolt 39. The use and positioning of such spacer bars is common in the art and does not form part of this invention. In this configuration, the generally cylindrical locking element 40 corresponds to the locking element 25 of FIG. 1 and it is urged outwardly by means of compression springs 41. In the configuration of FIG. 3, the bottom part of spring 41 is received into an appropriately formed recess 42 in the bottom of slot 33 while the upper end of spring 41 is received into a recess formed in the bottom part of a vertically movable spacer 43. The spacer 43 is formed with a generally arcuately formed receptacle-like surface 44 into which the locking element 40 can be received. It should be pointed out that the spacing element 43 contains an integrally formed wall 45 on each end which acts to define the lateral limits of the arcuate surface 44 and prevent locking element 40 from moving laterally in the general direction of the length of longitudinal slot 33.

Turning now to the modification shown in FIG. 4 of the drawings, common numbers are used to illustrate the parts that are in common with the locking mechanism defined in FIG. 3 of the drawings. In the case of FIG. 4, it will be obvious that the slot 35 is of a totally different configuration than that of the slots found in FIGS. 1 and 3. In this case, the bottom of the slot is provided with cup-shaped inserts 46 which will act to receive the lower ends of springs 41 in the same manner as do the openings provided in the configuration of FIG. 3. Since slot 35 is larger than that of FIG. 3, filler means 52 is mounted along one side of the slot and held in position by means of threaded elements 53 so that one of the undercut surfaces 15 acts to isolate the locking element 25 from the adjoining undercut surface. By utilizing the spacing element, the operation of the lock-up becomes identical to that of FIG. 3 of the drawings. It should be pointed out that in the cases of the lock-up shown in FIGS. 3 and 4, the plate roll 10 can be used in rotation only in one direction since it is not possible to have the leading edge locked on the right half of the device as seen in these Figures.

I claim:

1. In combination:

a. a printing cylinder in a printing press having a longitudinal slot formed in an outer surface thereof to define at least one undercut surface against which both ends of a flexible printing plate are clamped to hold the plate securely against the outer surface of said cylinder;

b. locking means including a plurality of individual cylinders substantially evenly spaced along the length of said longitudinal slot;

c. individual spring biasing means disposed in operative compression between the bottom of said longitudinal slot and a spring receiving opening in each of said cylinders to urge individually each of said cylinders outwardly against the overlapping ends of the plate and hold them against said undercut surface; and d. spacer means secured to the bottom of said longitudinal slot, said spacer means including a bar extending along the length of said slot, said bar including a plurality of evenly spaced protruding studs which receive said individual spring biasing means to hold said spring biasing means at fixed locations; said spring biasing means extending from the base of said studs to beyond the longitudinal extent of said studs and to the full depth of said spring receiving opening.

2. The combination according to claim 1, wherein each of said individual cylinders is substantially fixed in regard to rotation about an axis thereof.

* * * * *